United States Patent [19]

Gauchard

[11] 4,418,623

[45] Dec. 6, 1983

[54] APPARATUS FOR DISPERSING LIQUIDS

[76] Inventor: Fernand Gauchard, 87 Boulevard du Montparnasse, 75006 Paris, France

[21] Appl. No.: 281,879

[22] Filed: Jul. 9, 1981

[30] Foreign Application Priority Data

Jul. 9, 1980 [FR] France ..... 80 15255

[51] Int. Cl.[3] ..... F42B 25/12

[52] U.S. Cl. ..... 102/369; 102/367

[58] Field of Search ..... 102/363–370, 102/382, 386

[56] References Cited

U.S. PATENT DOCUMENTS

| | | | |
|---|---|---|---|
| 1,305,751 | 6/1919 | Stearns | 102/365 |
| 3,492,944 | 2/1970 | Reaves et al. | 102/367 |
| 3,685,453 | 8/1972 | Hamrick | 102/363 |
| 3,785,569 | 1/1974 | Helmrich | 102/368 |

FOREIGN PATENT DOCUMENTS

| | | | |
|---|---|---|---|
| 499064 | 1/1920 | France | 102/386 |
| 1034885 | 5/1953 | France . | |
| 1133064 | 3/1957 | France | 102/386 |

*Primary Examiner*—Charles T. Jordan

*Attorney, Agent, or Firm*—Young & Thompson

[57] ABSTRACT

Apparatus for dispersing liquids, comprises a casing which houses a reservoir for the liquid to be dispersed. A plurality of nozzles communicate with the reservoir, in which the liquid is placed under pressure. Any of a variety of devices for initiating dispensing of the liquid can be provided. Among these are, in the case of an aerial bomb, an inertial mass that ruptures the nozzles to open them upon impact of the bomb, or a slow-burning charge the pressure of whose combustion gases is applied to the liquid, or a parachute whose pull moves parts of the apparatus relative to each other to open the nozzles. The nozzle can selectively dispense directly to the atmosphere, to form a spray, or dispense through filters to form an aerosol.

6 Claims, 4 Drawing Figures

APPARATUS FOR DISPERSING LIQUIDS

The present invention relates to apparatus for dispersing liquids. The invention is more particularly concerned with strategical or tactical apparatus and the liquids in question are particularly in the nature of incapacitants, incendiary products, or are of toxic or microbiological character, whose maximum effectiveness is obtained by the impregnation of surfaces or dispersion in the atmosphere in the form of droplets, or as a mist, or preferably, as true aerosols of high stability and long duration.

The invention is also applicable to liquids having other applications, particularly defoliant liquids, bactericidal or insecticidal liquids, liquids which reduce the oxygen of the environment or foams for fighting fire or for the creation of regions of abnormally low oxygenating power or liquids adapted to create regions of an explosive atmosphere during their passage through reaction motors or the like. The invention is particularly applicable for military uses, as in bombs and the like, for dispersing liquid at high altitude or at ground level or on a region of the ground surrounding the impact point. The invention is also noteworthy as having small dimensions corresponding to the volume of liquid necessary to treat the zone in question, over which it can disperse an effective quantity of the liquid in question.

The apparatus according to the invention is characterized in that it comprises a casing inside which is provided a reservoir for the liquid, at least one dispersion nozzle in communication with the liquid reservoir, means for pressurizing the liquid to ensure its atomization by the nozzle or nozzles, and means for initiating the dispersion.

According to another characteristic, the dispersion nozzle is mounted on the interior of a chamber provided with means to ensure high stability of the atomized droplets in the dispersion. These means can be constituted by a stack of filters of plastic material of the type used for true aerosol generators such as those described in French Pat. No. 1,034,885, Mar. 30, 1951. To provide a plural-use device, the chamber may have direct outlets for the atomized liquid, outlets which can be closed to compel the atomized droplets to pass through the selective filters so as to produce a true aerosol. The means to disable or close the direct outlets may be constituted by a rotatable sleeve having openings which can be placed in registry with said direct outlets or out of alignment with them.

According to another characteristic, the apparatus comprises a firing device for an explosive charge ensuring the destruction of the device after dispersal of its supply of liquid.

According to a first embodiment, the pressurizing means is constituted by a volume of gas under pressure or of liquefied gas enclosed within the casing of the apparatus, the actuating means controlling the communication of the liquid volume with the atmosphere through the nozzles.

According to another feature, the actuating means is constituted by an inertial counterweight which breaks the end of the nozzles at the moment of impact or upon the actuation of the braking means such as a parachute or retrorocket. Preferably means are provided to maintain the counterweight in the position in which it does not interfere with the spray of the jets. In the case of an inertia counterweight acting by percussion, the latter is returned to its upper position by elastic means to expose the nozzles. In the case of a counterweight acting as a brake with respect to a bomb, means are provided to maintain the counterweight in its position in which it opens the closure means of the nozzles, in which position it frees the jet of the nozzles. The actuating means may also be constituted by a mechanical valve controlling the flow to the nozzle or by a small pyrotechnic charge ensuring the breaking of a closure member, one or the other being controlled by a firing pin, a timer, a barometric pressure detector, a radar or the like.

According to a second embodiment, the pressurizing means is constituted by a slow-burning pyrotechnic mass which gives off a large volume of gas which is ignited by the actuator. The actuator may also be in this case a firing pin, an inertia firer, a timer, a barometric pressure detector, a radar or the like.

The choice of the actuating means is a function of the type of liquid to be dispensed and of its manner of action. If it is relatively volatile and must be sprayed on the ground, the apparatus being positioned by suitable means, there will preferably be chosen a percussion or inertia device. If on the other hand it must be dispersed as a shower, by emission from a relatively high altitude and in a manner to ensure a rain of the liquid or the formation of an oxygen-free or explosive cloud, the carrier chosen will be preferably one that falls through the air and the actuating means will be selected from among timers, barometric pressure variation detectors, or, if greater precision is necessary, a proximity radar or Hertzian wave actuators. In the latter case, the apparatus may be of the known aerial bomb type with means for stabilizing its path as to altitude and trajectory, preferably according to a spiral trajectory or in loops to cover a greater area. The propulsion may be ensured by gravity, by ejection from dispersion nozzles which thus serve as reactive devices or by reactive devices using powder or a combustible mixture whose ejected streams constitute the principal or auxiliary propulsion for the liquid.

The apparatus may be incorporated in low trajectory devices of the ground-to-ground type, the firing means being of the timer type preferably ensuring simultaneously the actuation of the atomization and of the means to modify the trajectory. In this case, the ejection pressure of the gases of the reaction device may be utilized to ensure the ejection of the liquid.

In the case of a device ensuring dispersion after impact on the ground, with percussive or inertial activating means, the device may be maintained impacted into the ground in substantially vertical position with a small depth of penetration. To achieve this, the device is preferably provided with peripheral plates of spade shape maintained against the body of the device by frangible means and which spread upon impact to limit the penetration and maintain the device vertical.

When the device has to operate in all positions, particularly horizontal, the reservoir containing the liquid is preferably sealed and deformable under the action of the pressurizing means for the liquid. The feed passages of the nozzles may, particularly in the case of devices resting on the ground, comprise means, particularly ball valves, which deactivate the nozzles directed vertically toward the ground.

Other features and advantages of the present invention will become apparent from a consideration of the following description, taken in connection with the accompanying drawings, in which.

Figure 1:
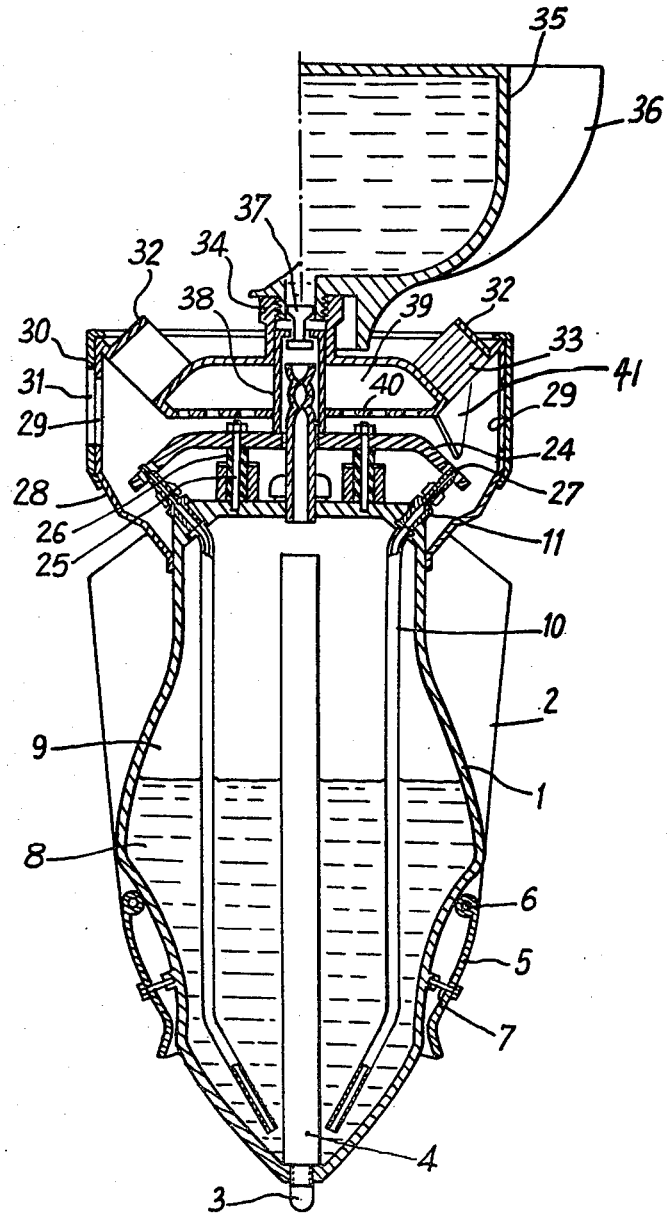
FIG. 1 is a cross-sectional view of a bomb that is actuated on impact, according to the present invention.

Referring now to the drawings in greater detail, and first to FIG. 1 thereof, the bomb shown therein is illustrated, on the left side thereof, in the armed condition to ensure a wetting dispersion, and, in its right portion, in the condition in which it is adapted to produce an aerosol.

The bomb comprises a hollow body 1, guiding vanes 2, a percussion firing device 3 and a timed explosive charge 4. Scoops 5 are pivoted at 6 on the body of the bomb and open on impact by rupture of pins 7. The liquid charge 8 is surmounted by a volume of gas 9 under pressure which may be replaced by a liquefied gas or a gas dissolved in the liquid. Tubes 10 are immersed in the liquid and feed nozzles 11 preferably of the type shown in FIG. 3.

Figure 3:
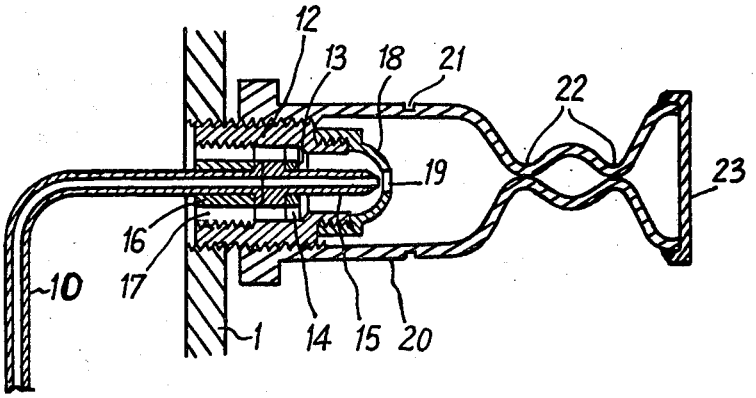
FIG. 3 is a cross-sectional view of a nozzle according to a preferred embodiment.

As shown in FIG. 3, the nozzle comprises a body 12 in which is mounted a ring 13 with radial openings 14, a nozzle outlet 15 against the rear face of which is locked, by a screw-threaded plug 16 provided with openings 17, the end of the immersed tube 10. On the outer end of the body is screwed a spherical dome 18 having an axially disposed ejection outlet orifice 19 adjacent the outlet of nozzle 15 and surrounding the same. On the exterior of body 12 is secured a rupturable cover 20 which has a rupture notch 21 and which is closed by being pinched together at 22 and by a soldered plug 23 or a soldered closure.

In the bomb shown in FIG. 1, the breaking off of the tube 20 to the right of the rupture notch 21 is ensured by an inertia mass 24 held by stays 25 and pressed upward by springs or rubber sleeves 26. This mass has openings 27 in which are disposed the cover tubes 20, and which are urged into confronting relationship with the jets of the nozzles by sleeves 26 after rupture of the cover tubes 20 actuates the dispersion. The pathway for filling the device is shown at 27 and is closed after filling. The bomb thus constituted comprises a bomb that disperses liquid by jets, the jets being actuated automatically upon rupture of the cover tubes 20 and the bomb self-destructing by the explosive charge 4 after a certain period of operation.

To provide a bomb adapted either to disperse as above, or to generate filtered and calibrated aerosols, a casing 28 is mounted on the rear portion surrounding the mass 24 and the nozzles 11. This casing has openings 29 in alignment with the nozzles and a peripheral skirt 30 having openings 31 is mounted about the casing so as to enable bringing the openings 31 into coincidence with the openings 29 (as seen at the left of FIG. 1) or for closing these openings (as seen at the right of FIG. 1). The casing comprises, on the other hand, on its upper surface, a number of passageways 32 in which may be mounted, to generate aerosols, stacks of filters of the type described in French Pat. No. 1,034,865.

In the case of utilization as an aerosol generator, the gaseous outflow through the nozzles 11 is too small to ensure the correct entrainment and dispersion of the aerosol. This outflow can even be nothing at all, if the plug 17 has no openings. To avoid this, the casing 28 is provided on its upper face with a screw-threaded connection 34 to which is secured, in the case of such utility, a bottle 35 of liquefied or compressed gas which is provided with radial stabilizing vanes 36. Opening of the bottle is ensured by the pulling down of plug 37 by stays 38 secured to mass 24, the pulling down of the plug placing the bottle in communication with the expansion chamber 39 which in turn communicates through a perforated plate 40 with the internal chamber of the casing 28. In this case, the skirt 30 is oriented to close the openings 29 so that the liquid jets from the nozzles 11 will break into fine droplets against the internal surface of the skirt, the dispersion being entrained by the turbulent gaseous current through the filters 33 in the passages 32 and the aerosols being dispersed by the external wall of the bottle 35. Any liquid flowing back from the filters 33 is directed by a gutter 41 at right angles to the jets of the nozzles which again project and disperse it. Any remaining liquid that accumulates in the casing 28 is ultimately dispersed upon explosion of the charge 4.

Figure 2:
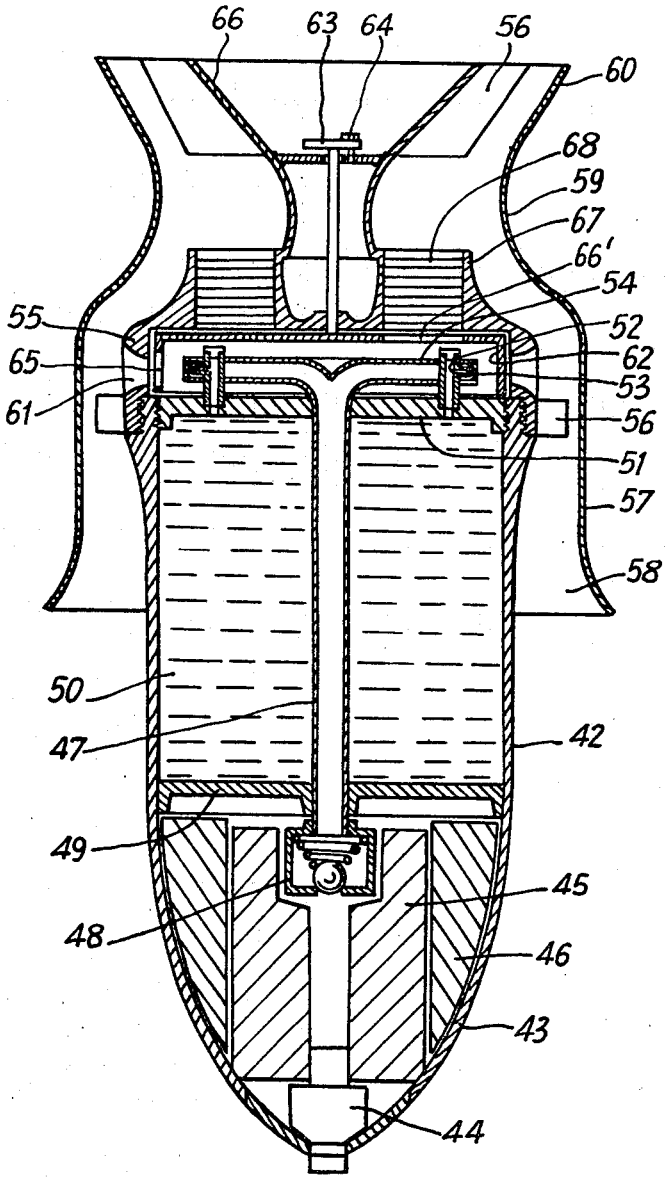
FIG. 2 is a cross-sectional view of a bomb that is actuated at an altitude which may also be combined with a self-driven engine.

The device of FIG. 2 comprises a cylindrical body 42 which terminates in a cap 43 at the apex of which is mounted a distance radar 44 or other device of the type for firing at an altitude. This device fires a slow-burning charge 45 which gives off a large volume of gas, and, after the combustion of the latter, an explosive charge 46. Along the axis of the body is mounted a tube 47 which terminates in a check valve chamber 48 which opens only under a predetermined pressure. A piston 49 is slidably mounted in body 42 so as to be driven back under the vapor pressure of the liquid 50 contained in the cylindrical body. A screw-threaded plate 51 forming a plug closes the cylindrical chamber 42 and carries nozzles 52 closed by ejectable rubber caps 53, the nozzles being surrounded by tubes 54 connected to tube 47. During burning of the charge 45, the plugs 53 are ejected by the pressure of the liquid and the liquid jets leaving through the nozzles are propelled by the gaseous flow in tubes 54.

To provide a device for dispersing as desired in the form of a mist or in the form of a true aerosol, a casing 55 is screw-threaded on the rear portion of the bomb so as to enclose the nozzles 52 and the tubes 54. This casing carries, by radial fins 56, a tube comprising a venturi 57 whose skirt flares forwardly at 58 and is constricted at 59 about casing 55 and flares again at 60. The casing 55 has openings 61 facing nozzles 52, which openings open into the tube 57. Inwardly of casing 55 in this region is a sleeve 62 rotatable by a handle 63 whose positions may be fixed by a pin 64.

In the adjusted position shown at the left of FIG. 2, the openings 65 provided in sleeve 62 register with openings 61 and the jets of nozzles 52 are projected directly into the air current through the venturi tube 57, which disperses them to eject them in the form of a mist through the divergent portion 60, at the center of which is mounted a deflector cone 66.

In the other position, shown at the right of FIG. 2, the openings 61 are closed and the jets break into a mist against the internal surface of the sleeve 62. Openings 66' provided at the base of the sleeve 62 are located in this position confronting passageways 67 atop the casing 55, in which passageways are mounted stacks of filters 68. The passageways 67 open in the restricted portion 59 of the venturi tube and, as a result, a true aerosol leaves the passageways and is taken up by the air flow created in the venturi tube 57 by the flow velocity or the speed of the device and are dispersed by the divergent portion 60.

Figure 4:
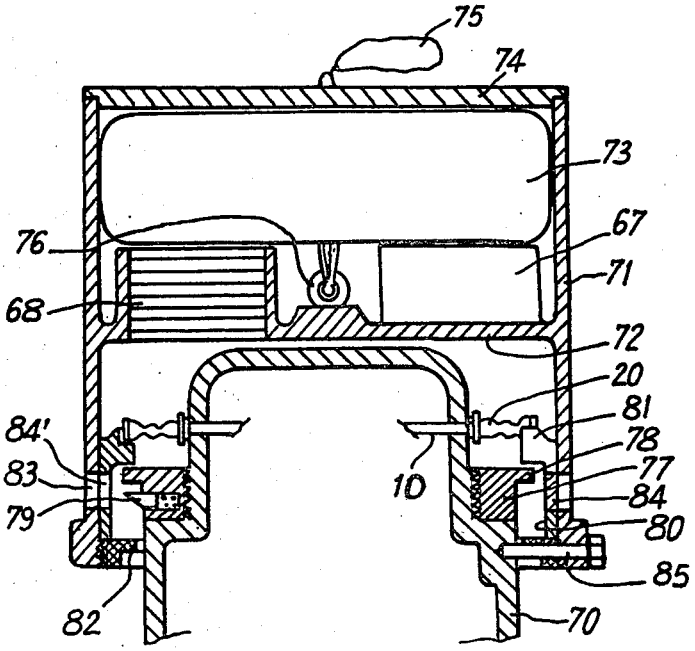
FIG. 4 is a cross-sectional view of a portion of a device provided with a parachute according to a third embodiment of the invention.

The device shown in FIG. 4 comprises a parachute bomb. At the rear portion of the body 70, comprising means for pressurizing the liquid, which may be any of the devices described above, is slidably mounted a cylindrical housing 71 divided into two chambers by a wall 72. The upper chamber constitutes a chamber for parachute 73, this chamber being closed by a cover 74 that may be pulled off by a parachute rip cord 75. The main chute is secured at 76 to the center of plate 72, which has passageways 67 provided with stacked filters 68. Nozzles of the type described in connection with FIG. 3, shown at 20 by their rupturable tubular covers, project radially from the rear portion of body 70 into the lower chamber of casing 71. Below nozzles 20 is screwed onto the body of the bomb a stop ring 77 which has a flange 78 below which are retractable detents 79. At the end of the lower chamber of casing 71 is mounted a sleeve 80 which comprises, at its upper part, saddles 81 to receive the ends of cover tubes 20 and, at its lower portion, an internal flange 82 adapted to abut against the flange 78 between the latter and detents 79. Casing 71 comprises, on the other hand, openings 83 with which rupturable or openable openings 84, provided in sleeve 80, are adapted to come into registry, the opening 84' in the left portion of FIG. 4 being shown opened. Securement pins 85 hold body 70 to casing 71 and are withdrawn when the bomb is armed.

When the device falls, and the parachute 73 opens, it exerts, by its point of connection 76, a pull on casing 71, which is transmitted by saddles 81 to the cover tubes 20 which rupture under the sudden force and the casing 71 slides until the flange 82 engages between the flange 78 and the detents 79. The nozzles which have been opened by the rupture of the tubular caps 20 are then aligned with openings 83. If the openings 84 are opened, the jets are propelled directly into the atmosphere. If the openings 84 have not been opened, the jets impinge against the latter and the micromist formed in the lower closed chamber of the casing 71 leaves through filters 28 in the form of true aerosols which are dispersed by the deflector action of the parachute.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

I claim:

1. Apparatus for dispersing liquids, comprising a casing, a reservoir inside the casing for the liquid to be dispersed, at least one dispersing nozzle for the liquid in communication with the reservoir, means to place the liquid in the reservoir under pressure to ensure its atomization by said at least one nozzle, means to initiate dispensing of the liquid through the nozzles, and direct outlets for the atomized liquid, means for closing said direct outlets, and means to direct the atomized liquid through filter means when said outlets are closed, thereby to produce an aerosol.

2. Apparatus as claimed in claim 1, in which said means for closing said outlets comprises a rotatable sleeve having openings therein adapted to register selectively with said outlets.

3. Apparatus for dispersing liquids, comprising a casing, a reservoir inside the casing for the liquid to be dispersed, at least one dispersing nozzle for the liquid in communication with the reservoir, means to place the liquid in the reservoir under pressure to ensure its atomization by said at least one nozzle, and means to initiate dispensing of the liquid through the nozzles, said means for initiating dispensing of the liquid comprising means for selectively opening said at least one nozzle, said opening means comprising an inertial mass adapted to break open the ends of the nozzles upon impact of the device.

4. Apparatus as claimed in claim 3, and elastic means for returning said inertial mass to an upper position out of the path of the nozzles.

5. Apparatus for dispersing liquids, comprising a casing, a reservoir inside the casing for the liquid to be dispersed, at least one dispersing nozzle for the liquid in communication with the reservoir, means to place the liquid in the reservoir under pressure to ensure its atomization by said at least one nozzle, means to initiate dispensing of the liquid through the nozzles, said means for initiating dispensing of the liquid comprising means for selectively opening said at least one nozzle, and means to slow the descent of the apparatus through the air, said initiating means comprising means responsive to the pull of said slowing means, to open said at least one nozzle.

6. Apparatus as claimed in claim 5, and means to retain said responsive means in the position to which it is pulled by said slowing means.

* * * * *